US009055614B2

(12) United States Patent
Kusaka et al.

(10) Patent No.: US 9,055,614 B2
(45) Date of Patent: Jun. 9, 2015

(54) INDUCTION HEATING DEVICE

(75) Inventors: Takaaki Kusaka, Hyogo (JP); Katsuyuki Aihara, Hyogo (JP); Toshihiro Keishima, Hyogo (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 2071 days.

(21) Appl. No.: 12/161,746

(22) PCT Filed: Jan. 29, 2007

(86) PCT No.: PCT/JP2007/051346
§ 371 (c)(1),
(2), (4) Date: Jul. 22, 2008

(87) PCT Pub. No.: WO2007/091440
PCT Pub. Date: Aug. 16, 2007

(65) Prior Publication Data

US 2010/0219181 A1 Sep. 2, 2010

(30) Foreign Application Priority Data

Feb. 7, 2006 (JP) ..... 2006-029375

(51) Int. Cl.
*H05B 6/06* (2006.01)
*A47J 31/40* (2006.01)

(52) U.S. Cl.
CPC ..... *H05B 6/062* (2013.01); *H05B 2213/04* (2013.01); *H05B 2213/05* (2013.01); *H05B 2213/07* (2013.01)

(58) Field of Classification Search
CPC ..... H05B 2213/04; H05B 2213/05; H05B 2213/07; H05B 6/062
USPC ..... 219/620, 635, 650, 663, 665, 667, 668, 219/671, 677; 99/280, 285, 288, 325, 342
See application file for complete search history.

(56) References Cited

U.S. PATENT DOCUMENTS 6,630,655 B2 * 10/2003 Fukunaga et al. ..... 219/711

FOREIGN PATENT DOCUMENTS

EP 1 571 888 A2 9/2005
JP 2003-133042 A 5/2003

(Continued)

OTHER PUBLICATIONS

JP_2004095309_machine_translation.pdf; JP_2003234168_machine_translation.pdf; JP_2003133042_machine_translation.pdf.*

(Continued)

*Primary Examiner* — Dana Ross
*Assistant Examiner* — Ket D Dang
(74) *Attorney, Agent, or Firm* — RatnerPrestia

(57) ABSTRACT

An induction heating device includes a top plate arranged to have an object placed thereon, a heating coil provided under below the top plate for heating the object, a sensor provided under the top plate for detecting a temperature of the object, a judging unit for judging whether or not the object is positioned directly above the sensor, a controller operable to allow the heating coil to heat the object in response to the temperature detected by the sensor detecting, and a position indicator provided at the top plate for indicating a position of the sensor. The position indicator includes a detectable area of the sensor, and is larger than the detectable area. This induction heating device securely positions the object directly above the sensor and detects a temperature of the object accurately, hence heating the object accurately at a predetermined temperature.

16 Claims, 3 Drawing Sheets

(56) References Cited

FOREIGN PATENT DOCUMENTS

| | | | | | |
|---|---|---|---|---|---|
| JP | 2003-133044 | A | | 5/2003 | |
| JP | 2003133042 | A | * | 5/2003 | ..... H05B 6/12 |
| JP | 2003-234168 | A | | 8/2003 | |
| JP | 2003234168 | A | * | 8/2003 | ..... H05B 6/12 |
| JP | 2004-095309 | A | | 3/2004 | |
| JP | 2004-095309 | A | | 3/2004 | |
| JP | 2004-95309 | A | | 3/2004 | |
| JP | 2004095309 | A | * | 3/2004 | ..... H05B 6/12 |
| JP | 2004-355962 | A | | 12/2004 | |
| JP | 2004-355962 | A | | 12/2004 | |
| JP | 2011-60781 | A | | 3/2011 | |
| JP | 2011-60782 | A | | 3/2011 | |
| WO | WO 2005/053362 | A1 | | 6/2005 | |

OTHER PUBLICATIONS

JP Office Action for 2010-287285, Jun. 28, 2011.
JP Office Action for 2010-287286, Jun. 28, 2011.
JP Office Action for 2006-029375, Oct. 26, 2010.
Supplementary European Search Report for Application No. EP 07 70 7577, Mar. 2, 2011, Panasonic Corporation.
International Search Report for PCT/JP/2007/051346 dated May 1, 2007.

* cited by examiner

INDUCTION HEATING DEVICE

This Application is a U.S. National Phase Application of PCT International Application PCT/JP2007/051346.

TECHNICAL FIELD

This invention relates to an induction heating device.

BACKGROUND ART

FIG. 2 is a cross sectional view of conventional induction heating device 5001. Top plate 2 for placing object 2, such as a pot, to be heated thereon is provided on an upper surface of housing 1. Heating coil 4 is for inductively heating object 2 is provided under top plate 3. Heating coil 4 is divided into inner coil 4A and outer coil 4B electrically connected to each other. Sensors 5, thermal sensing elements, such as thermistors, are provided on a lower surface of top plate 3 at a center area of heating coil 4, i.e., a center area of inner coil 4 and at an area between inner coil 4A and outer coil 4B. Sensors 5 are placed below object 2 and output signals in response to a temperature of object 2. Temperature calculator 6 calculates a temperature of object 2 based on the output signals. Controller 7 controls an electric power supplied to heating coil 4 based on the calculated temperature. Patent Document 1 discloses a conventional induction heating device including two sensors.

In the case that object 2 is not positioned directly above at least one sensor 5, conventional induction heating device 5001 has less heat responsiveness and less temperature detection accuracy of sensor 5 than the case that object 2 is positioned directly above sensors 5. In this case, induction heating device 5001 may not heat object 2 accurately at a predetermined temperature.

Patent Document 1: Japanese Patent Laid-Open Publication No. 2003-234168

SUMMARY OF INVENTION

An induction heating device includes a top plate arranged to have an object placed thereon, a heating coil provided under below the top plate for heating the object, a sensor provided under the top plate for detecting a temperature of the object, a judging unit for judging whether or not the object is positioned directly above the sensor, a controller operable to allow the heating coil to heat the object in response to the temperature detected by the sensor detecting, and a position indicator provided at the top plate for indicating a position of the sensor. The position indicator includes a detectable area of the sensor, and is larger than the detectable area.

This induction heating device securely positions the object directly above the sensor and detects a temperature of the object accurately, hence heating the object accurately at a predetermined temperature.

REFERENCE NUMERALS

11 Housing
11A Front Side

12 Object
13 Top Plate
13A Upper Surface of Top Plate
13C Light-Impenetrable Portion
14 Heating Coil
15A Sensor
15B Sensor
17 Controller
18 Judging unit
19 Position Indicator
21 Illuminator
115B Detectable Area of Sensor

DETAILED DESCRIPTION OF THE PREFERRED EMBODIMENT

Figure 1A:
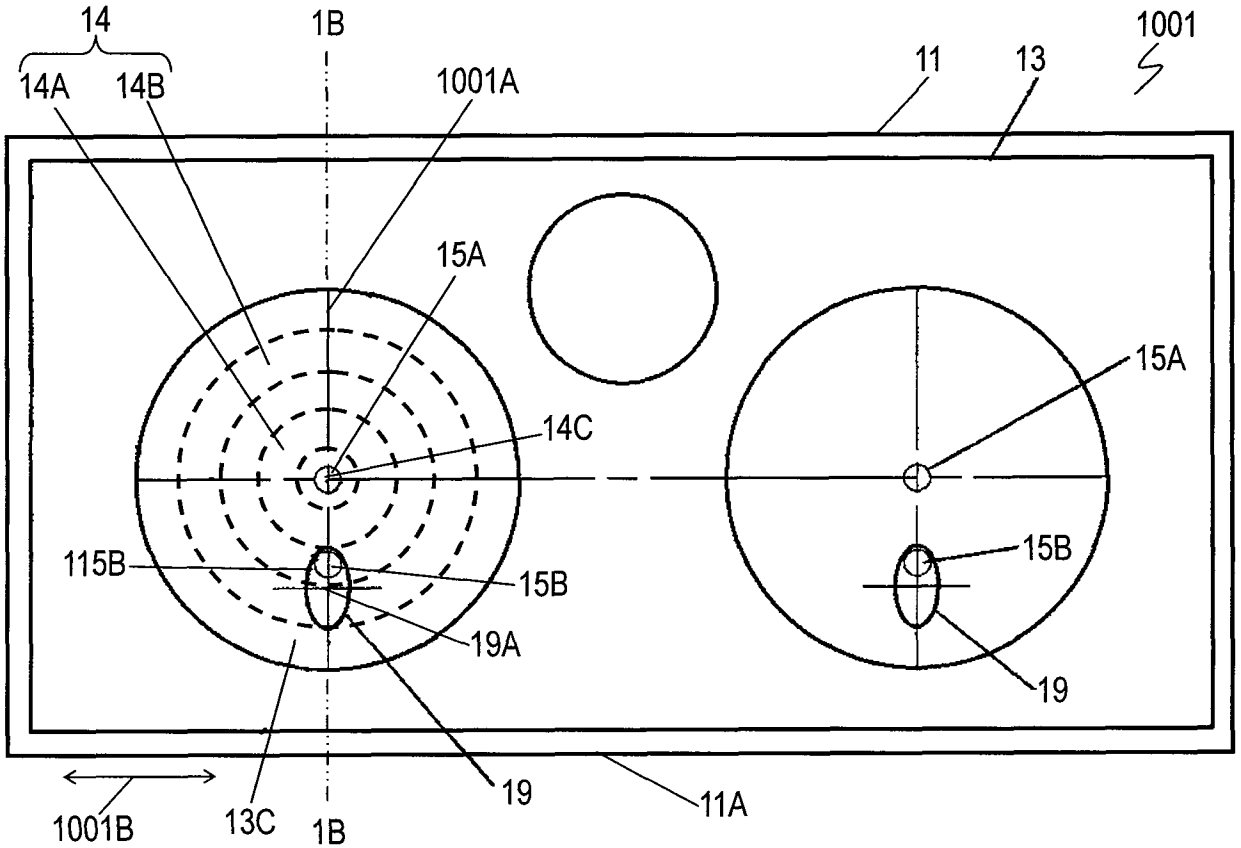
FIG. 1A is a plan view of an induction heating device in accordance with an exemplary embodiment of the present invention.
Figure 1B:
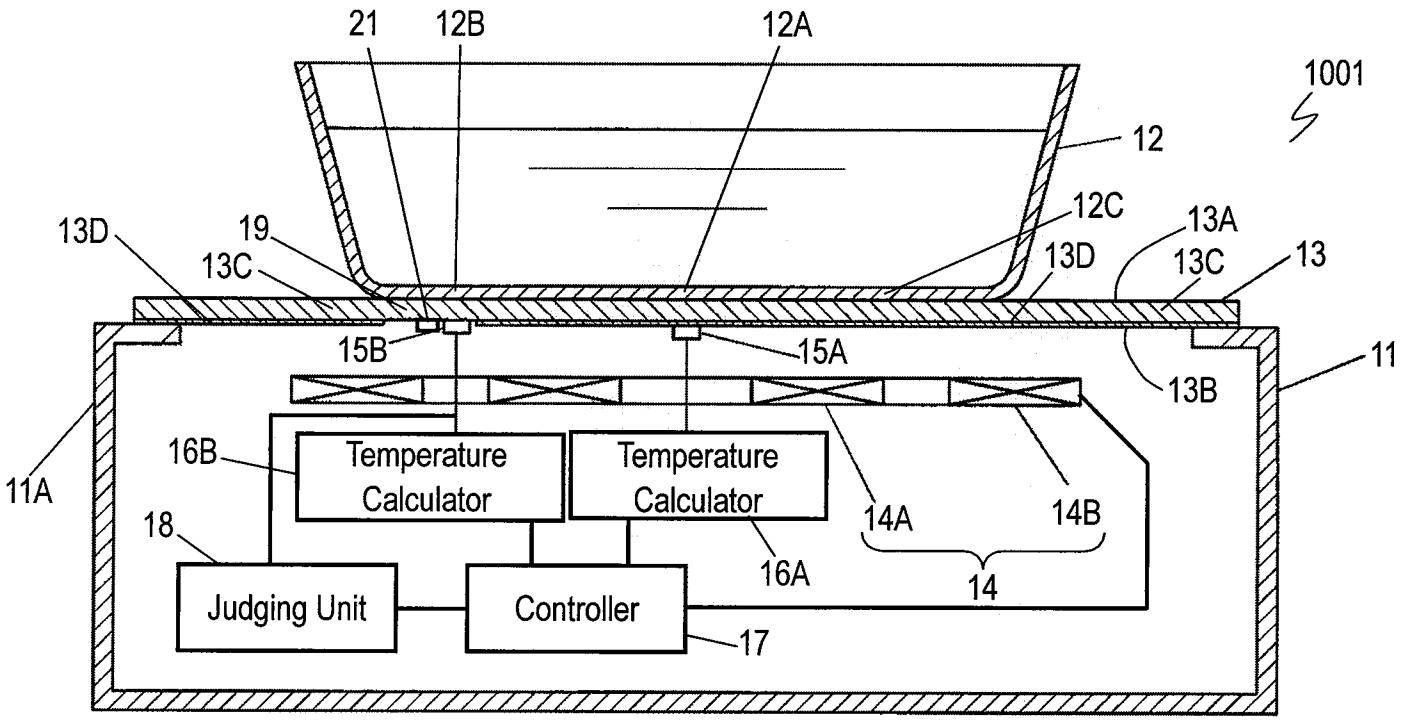
FIG. 1B is a cross sectional view of the induction heating device at line 1B-1B shown in FIG. 1A.
Figure 2:
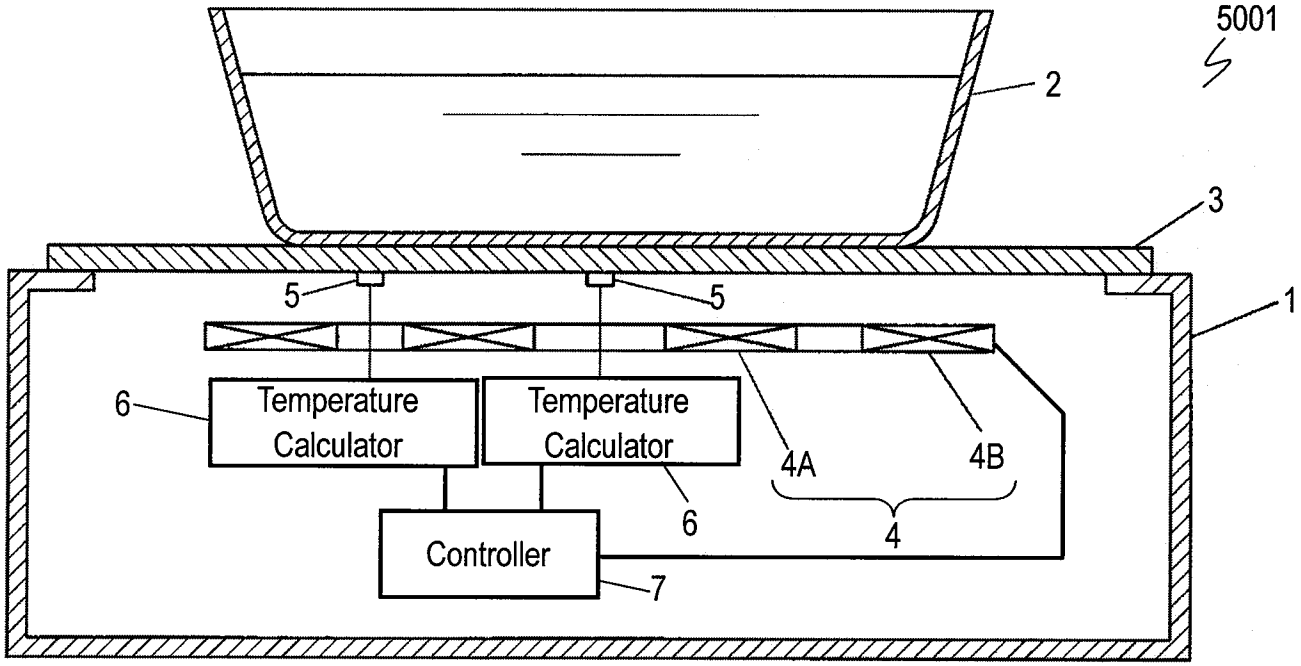
FIG. 2 is a cross sectional view of a conventional induction heating device.

FIG. 1A is a plan view of induction heating device 1001 in accordance with an exemplary embodiment of the present invention. FIG. 1B is a cross sectional view of induction heating device 1001 at line 1B-1B shown in FIG. 1A.

Top plate 13 is provided on an upper surface of housing 11. Top plate 13 has upper surface 13A and lower surface opposite to upper surface. Object 12, such as a pot, to be heated is arranged to be placed on upper surface 13A. Heating coil 14 for inductively heating object 12 is provided below top plate 13. Heating coil 14 is divided into inner coil 14A and outer coil 14B surrounding inner coil 14A. Inner coil 14A and outer coil 14B are electrically connected to each other. Inner coil 14A and outer coil 14B uniformly heat an entire bottom 12C of object 12. Sensors 15A and 15B which are thermal sensing elements of contact type, such as thermistors, are located on lower surface 13B of top plate 13 at center 14C of heating coil 14 that is center 14C of inner coil 14A and at an area between inner coil 14A and outer coil 14B, respectively. Sensor 15A and 15B may be thermal sensing elements of non-contact type, such as infrared sensors. In that case, the sensors may be placed apart from lower surface 13B of top plate 13 and directly under top plate 13. Sensors 15A and 15B are located directly under object 12 and output signals in response to temperatures of portions 12A and 12B of object 12, respectively. Temperature calculator 16A and 16B calculates the temperature of portions 12A and 12B of object 12 based on the signals output from sensor 15A and 15B. Controller 17 controls an electric power supplied to heating coil 14 based on the temperatures calculated by temperature calculator 16A and 16B. A user faces front side 11A of housing 11 for operating induction heating device 1001 from front side 11A. Housing 11 accommodates heating coil 14 and sensors 15A and 15B.

According to the embodiment, sensor 15B located between inner coil 14A and outer coil 14B detects the temperature of portion 12B of object 12 positioned directly above sensor 15B. Magnetic flux generated in a portion between inner coil 14A and outer coil 14B of heating coil 14 is largest among entire heating coil 14, and thus, is larger than magnetic flux generated at center 14C of inner coil 14A, accordingly raising the temperature of portion 12B of object 12 more easily than the temperature of portion 12A. Controller 7 controls the temperature of a portion of object 12 having a high temperature quickly and securely based on a signal output from sensor 15B for detecting the temperature of portion 12B.

Judging unit 18 judges whether or not object 12 is positioned directly above sensor 15B based on the signal output from sensor 15B. If sensor 15B is a thermal sensing element of contact type, such as a thermistor, judging unit 18 judges whether or not object 12 is positioned directly above sensor 15B based on an initial temperature and a rising curve of the temperature. If sensor 15B is a thermal sensing element of non-contact type, such as an infrared sensor, judging unit 18 stores a voltage output from sensor 15B detecting cold object 12 positioned directly above sensor 15B as a reference voltage, and judges whether or not object 12 is positioned directly above sensor 15B.

For example, when the voltage output from sensor 15B is higher than the reference voltage, sensor 15B receives light other than light from object 12, and judging unit 18 judges that object 12 is not positioned directly above sensor 15B. In this case, when the voltage output from sensor 15B is not higher than the reference voltage, sensor 15B does not receive light other than light from object 12, and judging unit 18 judges that object 12 is positioned directly above sensor 15B. Alternatively, if judging unit 18 does not detect a slope of a change of the voltage output from sensor 15B larger than a predetermined value during heating, judging unit 18 judges that object 12 is not positioned directly above sensor 15B. In this case, if judging unit 18 detects a slope of a change of the voltage output from sensor 15B larger than a predetermined value during heating, judging unit 18 judges that object 12 is positioned directly above sensor 15B. Alternatively, if judging unit 18 detects that the difference between the respective voltages output from sensor 15A and 15B is larger than a predetermined value during heating or that the difference between slopes of the changes of the respective voltages output from sensor 15A and 15B is larger than a predetermined value during heating, judging unit 18 judges that object 12 is not positioned directly above sensor 15B. In this case, if judging unit 18 does not detect that the difference between the respective voltages output from sensor 15A and 15B is larger than a predetermined value during heating or that the difference between slopes of the changes of the respective voltages output from sensor 15A and 15B is larger than a predetermined value during heating, judging unit 18 judges that object 12 is positioned directly above sensor 15B.

A method of judging whether or not object 12 is positioned directly above sensor 15B is not limited to the above methods. According to the embodiment, judging unit 18 judges whether or not object 12 is positioned directly above the sensor 15B based on the voltage output from sensor 15B located between inner coil 14A and outer coil 14B. In induction heating device 1001 according to the embodiment, judging unit 18 may judge whether or not object 12 is positioned directly above sensor 15A based on a signal output from sensor 15A located at center 14A of heating coil 14.

Controller 17 supplies an electric power to heating coil 14 to heat object 12 only if judging unit judges that object 12 is positioned directly above sensor 15B. In other words, controller 17 supplies the electric power to heating coil 14 to heat object 12 if judging unit 18 judges that object 12 is positioned directly above sensor 15B, and controller 17 does not supply the electric power to heating coil 14 thus does not heat object 12 if judging unit 18 judges that object 12 is not positioned directly above sensor 15B. In induction heating device 1001 according to the embodiment, judging unit 18 judges whether or not object 12 is positioned directly above sensor 15A based on the signal output from sensor 15A located at center 14C of heating coil 14. In device 1001, if judging unit 18 judges that object 12 is not positioned directly above sensor 14A, controller 17 does not supply the electric power to heating coil 14, namely, does not heat object 12.

Top plate 13 is made of light-transmittable heat resistant crystallized ceramic. Illuminator 21 including a luminescent material, such as an LED element, emitting visible light is provided near sensor 15B. When a user turns on the induction heating device, illuminator 21 illuminates top plate 13 from beneath top plate 13. The user visually confirms illuminator 21 itself illuminates or the luminescent material under top plate 13 illuminates via illuminator 21. In order for the user to recognize the position of sensor 15B, top plate 13 has position indicator 19 having substantially an oval shape indicating the position of sensor 15B. Sensor 15B detects a temperature within detectable area 115B having substantially a circular shape. Detectable area 115B is defined as follows. When object 12 is placed to face detectable area 115B, sensor 15B detects a temperature of a portion of object 12 facing detectable area 115B for controlling the temperature of object 12 appropriately. Position indicator 19 includes detectable area 115B and is larger than detectable area 115B. Sensor 15B is placed at a position deviating from center 14C of heating coil 14 toward front side 11A of housing 11 and deviating from center 19A of position indicator 19 toward center 14C of coil 14. Top plate 13 includes light-impenetrable portion 13C provided around position indicator 19 and surrounding position indicator 19. Light-impenetrable portion 13C is formed by printing, preventing light from transmitting through portion 13C. Position indicator 19 is a portion of top plate 13 which is not printed and transmits light.

Position indicator 19 indicating the position of sensor 15B is provided on top plate 13, so that the user can recognize the position of sensor 15B. Since position indicator 19 is larger than the detectable area of sensor 15B, the user can position object 12 directly above sensors 15A and 15B by placing object 12 at such a position that object 12 entirely hides position indicator 19. This operation allows sensors 15A and 15B to detect the temperature accurately, thereby inductive heating device 1001 to heat the object accurately at a predetermined temperature.

Sensor 15B is placed at the position deviating from center 14C of heating coil 14 toward front side 11A of housing 11 and deviating from center 19A of position indicator 19 toward center 14C of coil 14. That is, sensor 15B is located between center 14C of heating coil 14 and front side 11A of housing 11 and between center 19A of position indicator 19 and center 14C. Sensor 15B is located closer to front side 11A, i.e., the user, than center 14C is, so that the user can easily confirm the position of sensor 15B. Since sensor 15B is located in a direction from center 19A of position indicator 19 towards center 14C at sensor 15A is located, the user can position object 12 directly above sensor 15A and 15B by placing object 12 at such a position that object 12 entirely hides position indicator 19, thus using induction heating device 1001 easily.

When a user facing front side 11A of housing 11 places object 12 on upper surface 13A of top plate 13 directly above heating coil 14, the user generally faces from front side 11A toward straight line 1001A connecting sensor 15B and center 14A of heating coil 14, namely faces from the front side toward a back side. In this situation, the user positions object 12 on position indicator 19 along lateral direction 1001B perpendicular to straight line 1001A more easily than along straight line 1001A. Position indicator 19 has substantively the oval shape having a longitudinal direction, i.e., a long axis, along straight line 1001A. This shape restricts an area at which the user places object 12, and allow object 12 to be precisely positioned directly above sensors 15A and 15B. Position indicator 19 may have any of other shapes, such as a track shape or a rectangular shape, having a longitudinal direction along straight line 1001A instead of the oval shape.

Sensor 15B for detecting a temperature of portion 12B of object 12 placed straight above heating coil 14 may be an infrared sensor detecting an infrared ray emitted from portion 12B of object 12. Sensor 15B implemented by the infrared sensor allows judging unit 18 to judge precisely whether or not object 12 is positioned directly above heating coil 14. Sensor 15B implemented by the infrared sensor does not contacting lower surface 13B of top plate 13, and is placed away from top plate 13 farther than heating coil 14 is, thus detecting the temperature of object 12 with no contact. Since light transmittance of top plate 13 affects accuracy of detecting the temperature with the infrared sensor, temperature detectable area 115B having substantially a circular shape transmits the infrared ray enough to detect the temperature. The accuracy of detecting the temperature with the infrared sensor may decrease due to visible light or infrared ray emitted from a light source, such as an illumination lamp, other than object 12. In order to prevent such incidence, object 12 is positioned directly above detectable area 115B through which light transmits to sensor 15B. According to experiments, it was confirmed that a margin ranging preferably from 5 mm to 20 mm is provided around detectable area 115B in which sensor 15B detects the temperature. Thus, according to the embodiment, the long axis, i.e., the longitudinal length of position indicator 19 having the oval shape is provided by adding the margin ranging from 5 mm to 20 mm to a diameter of detectable area 115B of sensor 15B. Light-impenetrable portion 13C surrounding light-transmissible position indicator 19 securely shields disturbance light entering to position sensor 19 from a light source other than object 12, accordingly improving reliability of detecting the temperature with sensor 15B. Light-impenetrable portion 13C is formed by printing paint 13D that does not transmitting visible light on upper surface 13A, on lower surface 13B, or on both of surfaces 13A and 13B of top plate 13. Light-transmittable position indicator 19 is a non-printed portion of top plate 13 on which paint 13D is not printed. If sensor 14A is an infrared sensor, paint 13D is made of material transmitting infrared ray.

Light generated by illuminator 21 located near sensor 15B is transmitted through position indicator 19, and illuminates position indicator 19. The user recognizes the position and the size of position indicator 19 easily based on the illuminated light transmitted through position indicator 19A, accordingly positioning object 12 directly above sensor 15A and 15B easily.

In the case that induction heating device 1001 does not include illuminator 21, position indicator 19 may include a light-impenetrable portion formed around detectable area 115B, and detectable area 115B may not necessarily transmit visible light as long as it transmits infrared ray.

If sensors 15A and 15B are sensors of contact type, such as thermistors, top plate 13 may not transmit light.

The embodiment does not limit a scope of the invention.

INDUSTRIAL APPLICABILITY

An induction heating device according to the present invention allows an object to be securely positioned directly above a sensor, and detects a temperature of the object accurately, thereby heating the object accurately at a predetermined temperature.

The invention claimed is:

1. An induction heating device comprising:

a top plate arranged to have an object placed thereon;

a heating coil provided under below the top plate for heating the object;

a sensor provided under the top plate for detecting a temperature of the object within a detectable area;

a judging unit for judging whether or not the object is positioned directly above the sensor;

a controller operable to allow the heating coil to heat the object by controlling an electric power supplied to the heating coil in response to the temperature detected by the sensor detecting when the judging unit judges that the object is positioned directly above the sensor, and prevent the heating coil from heating the object when the judging unit judges that the object is not positioned directly above the sensor; and a position indicator provided at the top plate for indicating a position of the sensor, the position indicator including the detectable area of the sensor, the position indicator being larger than the detectable area.

2. The induction heating device of claim 1, further comprising a housing accommodating the heating coil and the sensor therein, the housing having a front side that a user faces to operate the induction heating device, wherein the sensor deviates from a center of the heating coil towards the front side and deviates from a center of the position indicator towards the center of the heating coil.

3. The induction heating device of claim 2, wherein the position indicator has substantially an oval shape.

4. The induction heating device of claim 3, wherein the sensor comprises an infrared sensor detecting infrared ray emitted from the object.

5. The induction heating device of claim 3, further comprising an illuminator for illuminating the position indicator.

6. The induction heating device of claim 5, wherein the position indicator transmits light, the top plate including a light-impenetrable portion surrounding the position indicator, the light-impenetrable portion not transmitting light.

7. The induction heating device of claim 2, wherein the sensor comprises an infrared sensor detecting infrared ray emitted from the object.

8. The induction heating device of claim 2, further comprising an illuminator for illuminating the position indicator.

9. The induction heating device of claim 8, wherein the position indicator transmits light, the top plate including a light-impenetrable portion surrounding the position indicator, the light-impenetrable portion not transmitting light.

10. The induction heating device of claim 1, wherein the position indicator has substantially an oval shape.

11. The induction heating device of claim 10, wherein the sensor comprises an infrared sensor detecting infrared ray emitted from the object.

12. The induction heating device of claim 10, further comprising an illuminator for illuminating the position indicator.

13. The induction heating device of claim 12, wherein the position indicator transmits light, the top plate including a light-impenetrable portion surrounding the position indicator, the light-impenetrable portion not transmitting light.

14. The induction heating device of claim 1, wherein the sensor comprises an infrared sensor detecting infrared ray emitted from the object.

15. The induction heating device of claim 1, further comprising an illuminator for illuminating the position indicator.

16. The induction heating device of claim 15, wherein the position indicator transmits light, the top plate including a light-impenetrable portion surrounding the position indicator, the light-impenetrable portion not transmitting light.

* * * * *